US005864963A

United States Patent [19]

Komulainen

[11] Patent Number: 5,864,963

[45] Date of Patent: Feb. 2, 1999

[54] ARRANGEMENT FOR REMOVING CONDENSATE FROM A CYLINDER AND METHOD FOR REGULATING THE REMOVAL OF CONDENSATE FROM A CYLINDER

[75] Inventor: Antti Komulainen, Keuruu, Finland

[73] Assignee: Valmet Corporation, Helsinki, Finland

[21] Appl. No.: 705,150

[22] Filed: Aug. 29, 1996

[30] Foreign Application Priority Data

Aug. 29, 1995 [FI] Finland ..... 954049

[51] Int. Cl.[6] ..... F26B 11/04; F28D 11/02

[52] U.S. Cl. ..... 34/124; 34/125

[58] Field of Search ..... 34/124, 125

[56] References Cited

U.S. PATENT DOCUMENTS

| | | | |
|---|---|---|---|
| 2,460,059 | 1/1949 | Bruker | 34/125 |
| 2,643,099 | 6/1953 | Kinraide et al. | 34/124 X |
| 2,879,039 | 3/1959 | Skinner | 34/124 X |
| 2,978,815 | 4/1961 | Hieronymus | 34/125 |
| 3,943,638 | 3/1976 | Robson | 34/125 X |
| 4,081,913 | 4/1978 | Salminen | 34/124 X |
| 4,183,149 | 1/1980 | Chance et al. | 34/124 X |
| 4,501,075 | 2/1985 | Jenkner et al. | 34/125 |
| 5,024,266 | 6/1991 | Critchlow | 34/125 X |
| 5,230,169 | 7/1993 | Jaatinen et al. | 34/124 |
| 5,335,427 | 8/1994 | Partio | 34/124 X |

*Primary Examiner*—Christopher B. Kilner
*Attorney, Agent, or Firm*—Steinberg & Raskin, P.C.

[57] ABSTRACT

An arrangement for removing condensate from an interior of a drying cylinder in a paper machine and a method for regulating the removal of such condensate. The arrangement includes a steam pipe through which steam is passed into the space in the interior of the drying cylinder, and a condensate pipe and fluidly connected syphon pipe through which condensate is removed from the interior of the drying cylinder. The steam pipe and the condensate pipe are passed through a revolving axle journal of the drying cylinder. The arrangement also includes a syphon support attached in the interior of the drying cylinder to revolve along with the drying cylinder and support the syphon. A support bearing is arranged to attach to the syphon support and the syphon support is connected with the construction of condensate and steam pipes.

23 Claims, 7 Drawing Sheets

120
20a
20b
20b'
x''
x'
25
240
24
20a
20b
220
20b'
22
s1
s2
120
26
20a
100
x2
x1
20b

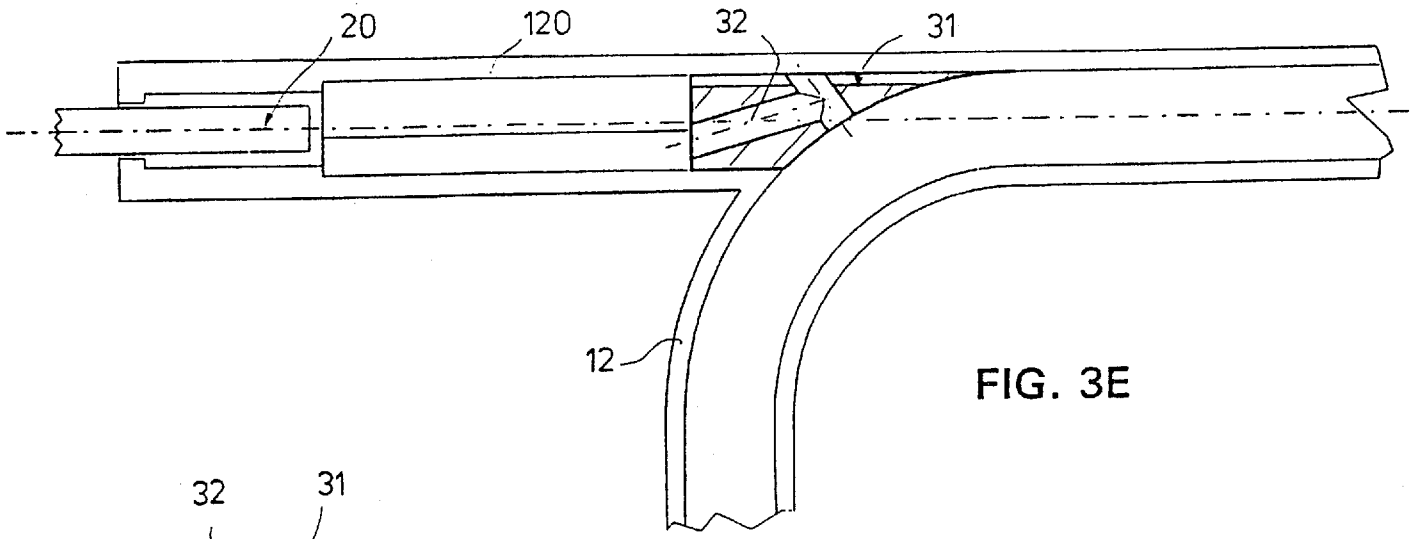
FIG. 3E
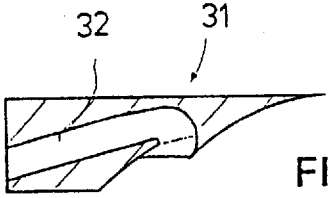
FIG. 3F
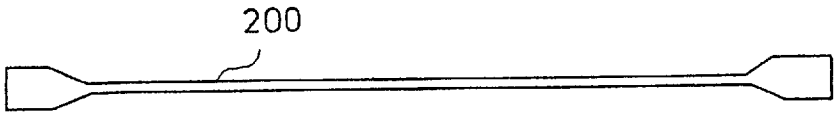
FIG. $3D_1$
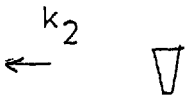
FIG. $3D_2$

ARRANGEMENT FOR REMOVING CONDENSATE FROM A CYLINDER AND METHOD FOR REGULATING THE REMOVAL OF CONDENSATE FROM A CYLINDER

FIELD OF THE INVENTION

The present invention relates to an arrangement for removing condensate from an interior of a cylinder such as a drying cylinder of a paper machine and a method for regulating the removal of condensate from an interior of such a cylinder.

BACKGROUND OF THE INVENTION

With increasing running speeds of a web in a paper machine and/or cylinder diameters of cylinders in the paper machine, the requirements imposed on the suspension of a condensate-removal syphon within an interior of such a cylinder become higher. Indeed, increasing paper machine running speeds result in increasing problems of oscillation in the case of pipes for removal of condensate and steam pipes. In a situation of oscillation, the end syphon situated within the interior of the cylinder and connected with the pipe for removal of condensate, through which syphon condensate is removed from the interior of the drying cylinder, tends to contact the inner face of the drying cylinder. From this contact, impulses arise which result in further increasing oscillation amplitudes and thereby causing damage to the constructions of the drying cylinder and internal elements.

OBJECTS AND SUMMARY OF THE INVENTION

It is an object of the present invention to provide a new and improved apparatus and method for removing condensate from an interior of a cylinder in a paper machine such as a drying cylinder in the drying section of the paper machine.

It is another object of the present invention to provide a new and improved apparatus and method for removing condensate from an interior of a drying cylinder of a paper machine which includes a syphon construction which is attached to an inner surface of the drying cylinder.

It is yet another object of the present invention to provide a syphon construction in which the suspension of the syphon is better than in prior art constructions.

It is still another object of the present invention to provide a new and improved method and apparatus for regulating the temperature of a surface of the cylinder by varying the distance between a condensate-inlet opening of the syphon and the inner face of the cylinder.

In order to achieve these objects and others, in the syphon apparatus in accordance with the invention, the syphon pipe for removal of condensate is supported on a fixed syphon support construction arranged inside the cylinder and revolving along with the cylinder, e.g., it is fixed to an inner face of the cylinder. A bearing arrangement is arranged between the syphon pipe for removal of condensate and the fixed syphon support construction placed in the interior of the cylinder. In one embodiment of the invention, the syphon support revolving along with the cylinder is connected with an axle journal fixed permanently, e.g., by threading, into a threading in the center piece of the syphon support. The axle journal also comprises an end bearing cylinder arranged in the interior of an end of the condensate pipe so that the syphon support is freely rotatable in relation to the condensate pipe.

In one particular embodiment of the invention, the bearing arrangement includes an eccentric mechanism by whose means the distance of the condensate-inlet opening of the syphon pipe from the inner face of the cylinder can be adjusted as desired in accordance with the situation.

According to the invention, it is possible to use an eccentric bushing connected to the pipe for removal of condensate. When the eccentric bushing is rotated in a backup bushing in the pipe for removal of condensate, the distance of the end of the pipe for removal of condensate, i.e., of the condensate-inlet opening of the syphon pipe, from the inner face of the drying cylinder is regulated, and thereby it is possible to regulate the thickness of the condensate layer that is collected on the bottom of the cylinder. This eccentric regulation can be carried out from the center of the pipe for removal of condensate by using a separate rotation tool. The rotation tool can be rotated from one end of the condensate removal pipe from outside the cylinder.

In an alternative embodiment of the invention, the bearing arrangement is constructed such that the bearing comprises a stationary axle journal connected to the condensate pipe, which axle journal includes a shaft part and a cylinder part. The cylinder part is connected with the condensate pipe. The shaft part of the axle journal operates as a glide bearing. Rotation of the axle journal is prevented by means of a groove coupling or other suitable rotation prevention means. The axle journal is mounted eccentrically in the cylinder part, which is further connected to an extension of the condensate pipe by means of a groove coupling. The eccentric regulation can be carried out from the center of the condensate pipe from outside the cylinder by means of a separate tool by passing this tool into a threaded hole in the end of the cylinder part. The tool is attached to the threaded hole, and by shifting the tool along a linear path, the groove coupling is opened and the axle journal in the interior of the condensate pipe is shifted so that its teeth become free from engagement with the backup grooves in the outside bushing-shaped extension part connected with the condensate pipe. After this, the tool is rotated to the desired eccentric position, the inner axle journal being placed in the desired regulation position and locked in that position by means of a linear movement by bringing the teeth of the groove coupling into engagement.

The puller tool and the tool for eccentric regulation can be constructed such that they are placed permanently in the interior of the condensate pipe. In such a case, the end of the puller tool may include a marker groove which indicates the position of the eccentric cam. Further, the apparatus can include regulation marks, in which case, depending on the position of rotation of the tool, it is possible to read the distance of the syphon from the inner face of the drying cylinder from the regulation marks.

According to the invention, the arrangement can also be constructed such that the condensate pipe itself operates as the regulation arm. In such a case, the distance of the end of the syphon from the inner face of the drying cylinder is regulated by rotating the eccentric condensate pipe. The flanges of the condensate pipe are further arranged to follow the inner face of the steam pipe. In the construction, the support bearing arrangement is connected with the end of the condensate pipe.

Within the scope of the invention, it is possible to form a bearing arrangement that is lubricated by means of water. In such a case, part of the condensate water is passed to the bearing arrangement. In the direction of flow of the condensate, it is possible to arrange a trap-like duct passage that guides part of the condensate water to the bearing.

In the invention, the syphon pipe situated in the interior of the cylinder is suspended precisely such that it is free of oscillation also at running speeds considerably higher than those employed at present. The present invention also permits regulation of the surface temperatures of the cylinders within a steam group. The construction of the syphon apparatus in accordance with the present invention is adjustable with respect to the inner surface of the cylinder. Furthermore, the drying capacity can be maximized, and by means of the construction it is possible to regulate the surface temperatures of the cylinders reliably. Also, the syphon construction in accordance with the present invention is favorable in view of maintenance operations.

In accordance with the invention, the syphon is suspended by means of support bearings which can be replaced from outside the cylinder without opening the cylinder. In the construction of the present invention, the regulation of the thickness of the condensate layer in the cylinder, and thus the regulation of the surface temperature of the cylinder, takes place by adjusting the distance of the syphon from the inner face of the cylinder.

In a most basic embodiment of the invention, the arrangement for removing condensate from an interior of a drying cylinder having a revolving axle journal is applied in connection with drying cylinder including a steam pipe for passing steam into the interior of the drying cylinder and a fixed condensate pipe arranged in association with the axle journal for passing condensate out of the interior of the drying cylinder and a syphon pipe fluidly communicating with the condensate pipe and arranged in the interior of the drying cylinder such that condensate is drawn from an inner face of the drying cylinder through the syphon pipe and passed to the condensate pipe to be removed from the interior of the drying cylinder. In accordance with the invention, the arrangement includes syphon support means arranged in the interior of the drying cylinder for supporting the syphon pipe and which are coupled to the drying cylinder such that the syphon support means rotate with the drying cylinder, and bearing means coupled to the syphon support means and at least the condensate pipe for enabling rotation of the syphon support means relative to the condensate pipe. The bearing means comprise a member having a central axis coincident with a central axis of the syphon support means such that the syphon support means rotate with the drying cylinder about the member of the bearing means. Alternatively, the bearing means comprise a support bearing engaging with the syphon support means and directly coupled to the condensate pipe, in which case, the condensate pipe may comprise an end piece arranged to receive the support bearing. In this embodiment, the end piece comprises a hollow, bushing part including a connection to a flow passage of condensate through the condensate pipe, and is arranged in the vicinity of an intersection between the syphon pipe and the condensate pipe. Lubrication means for lubricating a region of opposition between the end piece and the support bushing should be provided and may comprise a water guide arranged in the end piece to direct condensate passing through the condensate pipe to the region.

In another embodiment, the bearing means comprise an axle journal including a cylinder part arranged in association with the condensate pipe and a shaft part connected to the cylinder part and rotatably coupled to the syphon support means. The syphon support means comprise a centerpiece connecting to the shaft part and the condensate pipe comprises an end piece arranged to receive the cylinder part in an interior thereof such that a glide bearing is formed between an outer face of the cylinder part and the end piece. The arrangement can also include coupling means for coupling the shaft part to the centerpiece of the syphon support means, e.g., cooperating threads arranged on the shaft part and the centerpiece of the syphon support means.

In yet another embodiment of the arrangement in accordance with the invention, the bearing means comprise regulation means for regulating a distance between an end of the syphon pipe proximate the inner face of the cylinder and the inner face of the cylinder. Such regulation means comprise an axle journal including a cylinder part and a shaft part connected to the cylinder part and rotatably coupled to the syphon support means, and an eccentric bushing arranged at an end of the end piece. The bushing has a central cavity situated eccentrically in relation to an outer face of the bushing and the cylinder part of the axle journal of the bearing means is arranged in the central cavity of the bushing such that by rotating the bushing, the bushing is moved into different positions relative to the axle journal of the bearing means to thereby cause the condensate pipe and the syphon pipe to be moved relative to an inner face of the drying cylinder. Indicator means may be arranged on an outside of the cylinder for indicating a position of the bushing and thus a distance of the syphon pipe from the inner face of the cylinder.

In still another embodiment of the invention, the condensate pipe comprises an end piece and the bearing means comprise an axle journal including a cylinder part arranged at least partially in connection with the end piece and a shaft part connected to the cylinder part and rotatably coupled to the syphon support means. The cylinder part has an outer circumferential surface having a plurality of grooves and the end piece has a projection engageable with one of the grooves such that a groove coupling is formed between the projection of the end piece and one of the grooves and rotation of the axle journal of the bearing means is prevented.

In still another embodiment of the invention, the condensate pipe comprises an end piece and the bearing means comprise an axle journal including an elongate cylinder part arranged at least partially in connection with the end piece and a shaft part connected to the cylinder part and rotatably coupled to the syphon support means. The shaft part has a central axis offset from a central axis of the cylinder part and the cylinder part includes a threaded hole in one end. The cylinder part and thus the condensate pipe are rotatable to a selected position of rotation relative to the shaft part and thus the syphon support means to thereby regulate a distance between an end of the syphon pipe proximate the inner face of the cylinder and the inner face of the cylinder. A rotation tool can be suppled to cooperate with the threaded hole in the cylinder part for removing the bearing means without disassembly of the axle journal of the cylinder and for adjusting a distance between an end of the syphon pipe proximate the inner face of the cylinder and the inner face of the cylinder.

In yet another embodiment of the invention, to enable deflection of the cylinder with respect to the arrangement, the syphon support means comprises a centerpiece arranged in a central region of the interior of the cylinder, at least one arm extending from the centerpiece to the inner face of the drying cylinder, possibly a plurality of arms spaced equidistant from another about the inner periphery of the cylinder, and connected to the inner face of the cylinder, and pivot means for enabling pivotal movement of the centerpiece and the at least one arm relative to the bearing means.

In another embodiment, the bearing means comprise a support bearing arranged in connection with the syphon support means and the condensate pipe is rotatably coupled to the support bearing such that the condensate pipe is rotatable with the syphon support means. The syphon pipe is connected to the steam pipe and the condensate pipe is arranged within the steam pipe. First and second flanges are connected to the condensate pipe and extend outward from the condensate pipe to engage an inner face of the steam pipe. The condensate pipe has apertures arranged between the first and second flanges and the steam pipe has an aperture situated between the first and second flanges leading to the syphon pipe to enable fluid communication between the condensate pipe and the syphon pipe. The axle journal of the cylinder has an inlet connection for steam leading to the steam pipe and an outlet connection for condensate leading from the condensate pipe. A third flange is then connected to the condensate pipe for separating the inlet connection from the outlet connection, and rotation means for rotating the condensate pipe are provided. The rotation means comprise an elongate pin connected at a first end to the third flange, and a cover connected to a second end of the pin and include visible indicator marks for showing a rotation position of the condensate pipe. The condensate pipe may have an axis of rotation arranged eccentric in relation to a central axis of the steam pipe such that by rotating the condensate pipe, the steam pipe and the syphon pipe are movable to different distances from the inner face of the cylinder in view of the engagement of the first and second flanges with the steam pipe.

In accordance with the invention, the method for regulating the removal of condensate from an interior of a drying cylinder into which steam is passed through a steam pipe and condensate is removed from the interior of the drying cylinder through a syphon pipe arranged in the interior of the cylinder and a condensate pipe fluidly communicating therewith comprises the steps supporting the syphon pipe in the interior of the cylinder by means of a syphon support attached to an inner face of the cylinder such that the syphon pipe revolves along with the cylinder, arranging a support bearing between the syphon support and the condensate pipe such that the syphon support is rotatable relative to the condensate pipe, and regulating a temperature of a surface of the cylinder, e.g., the outer surface, by adjusting a distance between a condensate inlet opening of the syphon pipe and the inner face of the cylinder. The syphon pipe may be connected to the condensate pipe whereby the step of regulating the temperature of the outer surface of the cylinder comprises the step of providing the support bearing with an eccentric bushing such that the condensate pipe is rotatable relative to the syphon support in an eccentric manner. As such, the eccentric bushing is rotated to thereby cause rotation of the condensate pipe relative to the syphon support in an eccentric manner and movement of the condensate pipe and syphon pipe to a certain distance from the inner face of the cylinder so as to regulate the removal of condensate from the inner face of the cylinder and adjust the temperature of the outer surface of the cylinder.

BRIEF DESCRIPTION OF THE DRAWINGS

The following drawings are illustrative of embodiments of the invention and are not meant to limit the scope of the invention as encompassed by the claims.

FIG. 3D, shows the tool used for regulation of the syphon construction in an arrangement in accordance with the invention.

FIG. 3$D_2$ shows the tool used for regulation of the syphon construction in an arrangement in accordance with the invention viewed in the direction of the arrow $k_2$ in FIG. 3$D_1$.

FIG. 3E is a view of a water lubrication construction of the bearing system in an arrangement in accordance with the invention.

FIG. 3F is a view of a second embodiment of the guide piece used for water lubrication of the bearing system in an arrangement in accordance with the invention.

DETAILED DESCRIPTION OF THE PREFERRED EMBODIMENTS

Figure 1:
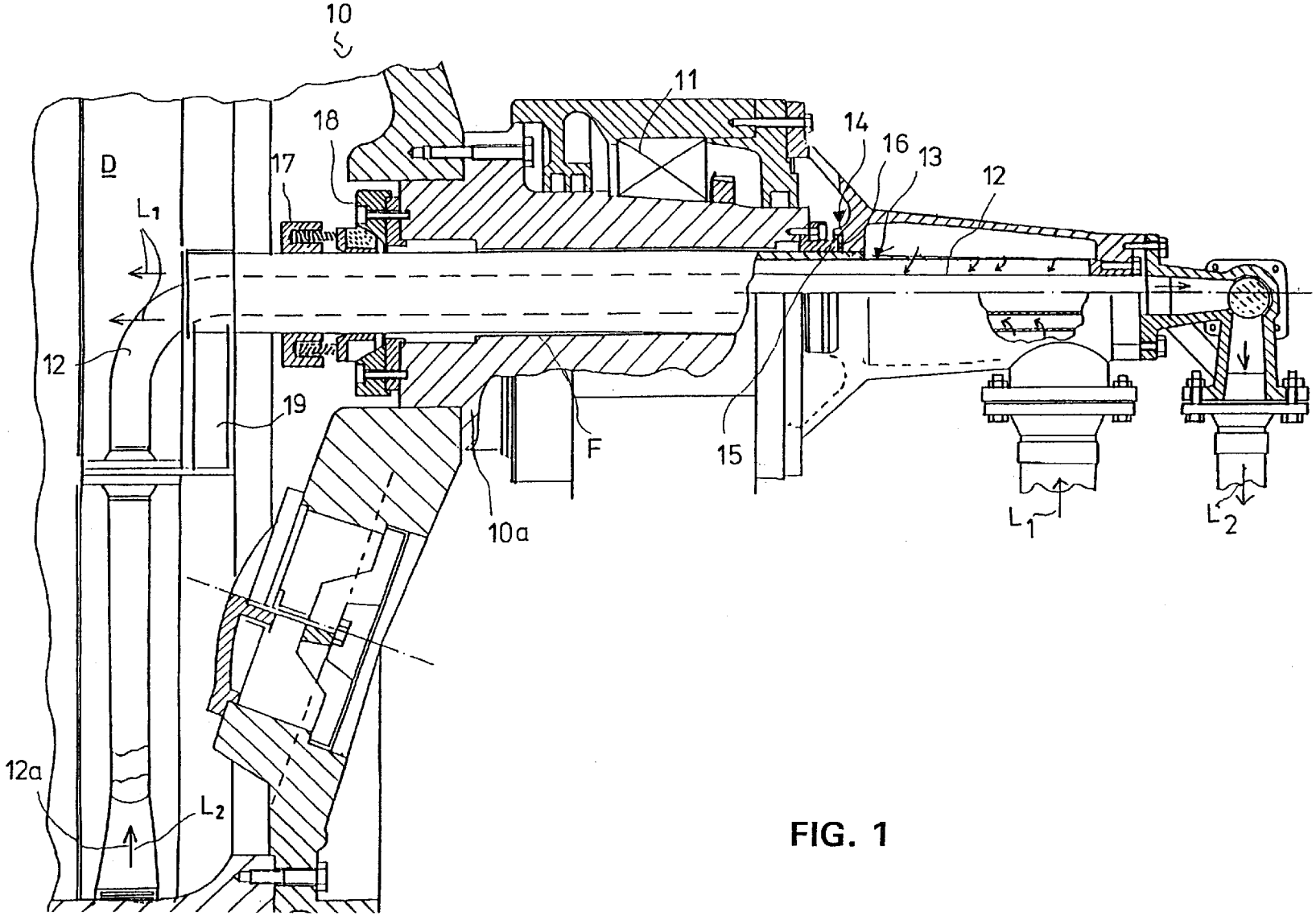
FIG. 1 is a partial view of a prior art construction for removal of condensate from an interior of a cylinder.

Referring to the accompanying drawings wherein the same reference numerals refer to the same or similar elements, FIG. 1 shows a prior art suspension construction of a condensate pipe for use in connection with a paper machine cylinder. In the embodiment shown in FIG. 1, illustrated as a longitudinal sectional view of an end of a drying cylinder 10 next to a condensate/steam coupling 14, the steam (arrows $L_1$) is passed into a space D in the interior of the cylinder. The steam delivers its heat in the interior D of the cylinder, i.e., to the mantle of the cylinder 10 such that heat is transferred to the outer surface of the cylinder, and is condensed, e.g., upon cooling, to thereby form a condensate on the inner face of the mantle of the cylinder 10, and the condensate is passed in the manner indicated by the arrow $L_2$ out of the interior of the cylinder through a syphon 12*a* and a condensate pipe 12 associated therewith. The drying cylinder 10 is arranged to revolve by means of its axle journal on support of bearings 11 rotatably mounted about a shaft 10*a*. Both the condensate pipe 12 and a steam pipe 13 are passed centrally through an interior space in the shaft 10*a*. Further, the condensate pipe 12 passes inside the steam pipe 13. At the end of the shaft 10*a*, there is the condensate/ steam coupling 14 which includes a seal 16 connected with a flange 15. The shaft 10*a* and the flange 15 revolve and are pressed against the non-revolving end seal 16. In this manner, the flow of steam out through the narrow annular flow passage F between the steam pipe 13 and the inner surface defining the interior space of the shaft 10*a* from the interior D of the cylinder 10 is prevented. In the prior art embodiment shown in FIG. 1, the axle journal includes an inside or internal bearing member 17 which is sealed against a backup bearing member 18 connected with the steam pipe 13. By means of the support bearing members 17,18, the stationary steam pipe 13 is supported on the revolving shaft 10*a*. The condensate pipe 12 is attached to the steam pipe 13 by means of a suspension collar 19.

Figure 2:
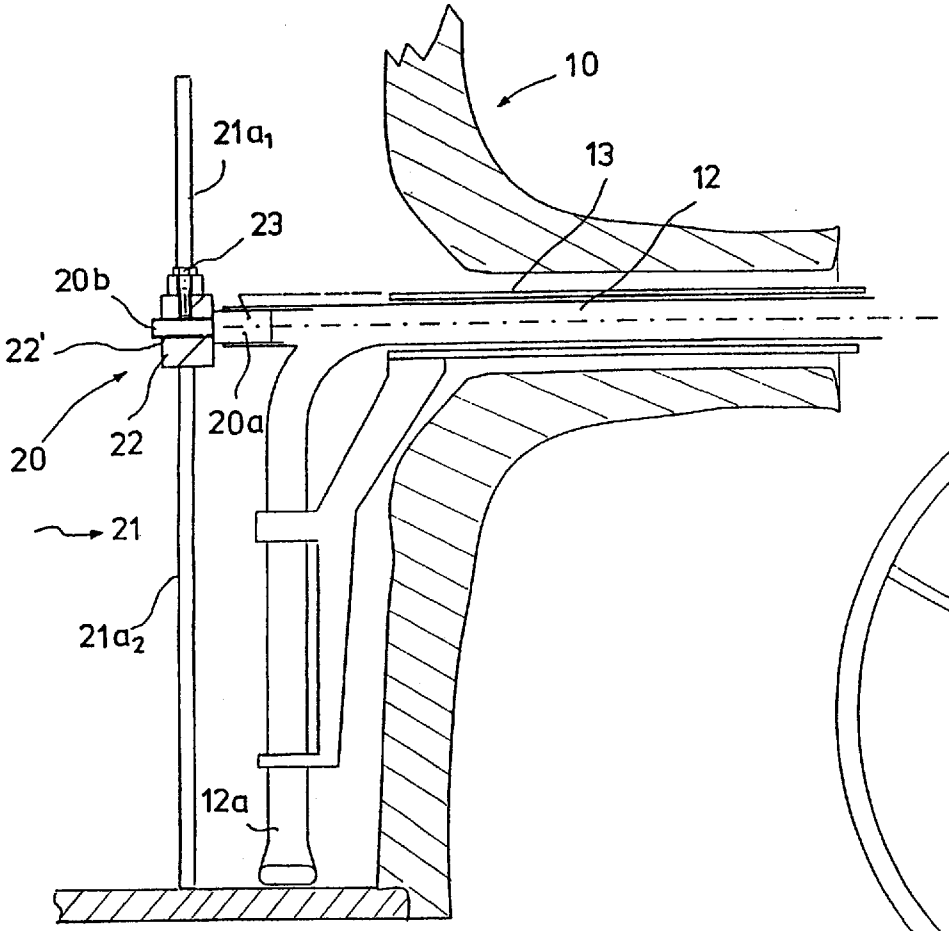
FIG. 2 is a partial side view of the principle of journaling in an arrangement accordance with the present invention and which can be applied in the method in accordance with the invention.

FIG. 2 is a partial side view of the journaling principle of the syphon construction in accordance with the present invention taken at the end of the drying cylinder having an axle journal 10 at each end. In the manner shown in FIG. 2, a support bearing 20 is mounted on a center piece 22 of a syphon support construction 21. Arms 21$a_1$, 21$a_2$, . . . of the syphon support 21 are rigidly connected to the center piece 22 by means of screw members 23 or other appropriate connecting means.

According to the invention, the support bearing 20 is also connected with the center piece 22 so that a shaft part 20*b* of the axle journal of the support bearing 20, which shaft part 20*b* is provided with a threading 20*b*' on its outer face, is threaded thereby into a screw hole 22' in the center piece 22, i.e., the support bearing is fixedly retained in connection with the center piece. The shaft part 20*b* includes a related cylinder part 20*a* coupled thereto, which operates as a glide bearing part and is placed inside the an extension piece or end piece 120 of the stationary condensate pipe 12 (FIG. 3A). Thus, a portion of the inner face of the end piece 120 operates as one of the bearing faces in the bearing arrangement shown in FIG. 2 upon rotation of the syphon support construction 21, by virtue of its attachment to the cylinder, and the support bearing 20 connected to the syphon construction 21.

According to the invention, the axle journal of the support bearing 20 can be replaced, for example, so that the end of the cylinder part 20*a* is provided with a threading, to which a rotation tool can be coupled. The entire axle journal of the support bearing 20 can be rotated apart from its center piece 22. Thus, the support bearing can be replaced through the interior of the steam pipe 13 and the condensate pipe 12 from outside the steam cylinder.

FIG. 3A shows the construction of FIG. 2 on an enlarged scale. As shown in larger detail herein, the axle journal of the support bearing 20 comprises the shaft part 20*b* and the cylinder part 20*a*, which is substantially cylindrical and directly connected to the shaft part 20*a* in the illustrated embodiment. The outer face of the cylinder part 20*a* operates as one backup face of the glide bearing, in opposed relationship to a portion of the inner surface of the extension piece 120. The shaft part 20*b* is substantially cylindrical and is provided with a threading 20*b*' over substantially its entire outer circumferential surface. The cylinder part 20*a* is arranged at least partially within the extension piece 120.

FIG. 3B shows an embodiment of the invention in which a construction is used that is in most other respects similar to that shown in FIGS. 2 and 3A, but in which the construction additionally includes a mechanism for regulation of the syphon pipe, by whose means the distance of the syphon pipe 12*a* from the inner face of the drying cylinder, and more particularly the condensate inlet opening at the end of the syphon pipe 12*a* proximate the inner face of the cylinder, can be set and regulated as desired, e.g., in accordance with the operating situation. As shown in FIG. 3B, an extension piece 120 is attached to the long straight portion of the condensate pipe 12 and has a central axis denoted by X'. In the interior of the extension piece 120, a rotatable bushing part is arranged and is also referred to as an eccentric bushing 24. Eccentric bushing 24 includes a hole 240 eccentric in relation to the outer face of the bushing, and the central axis of the hole 240 is denoted by X" (by virtue of the eccentricity, the axis X" is axially offset from the axis X' which axial offset is represented by the space between axis X' and axis X'). The end of the bushing 24 is provided with a groove 25, to which a rotation tool can be coupled. When the bushing 24 is rotated, it is placed in different eccentric positions. As the axle journal 20*a*,20*b* of the support bearing 20 is in an invariable, fixed position in the radial direction of the cylinder, the position of the extension piece 120 and the connected syphon pipe in relation to the cylinder face is changed when the bushing 24 is rotated by means of the adjustment or rotation tool.

As shown in FIG. 3B, the cylinder part 20*a* of the axle journal of the support bearing 20 is placed inside the eccentric bushing 24. The related shaft part 20*b* of the axle journal of the support bearing 20 is connected by means of the threading 20*b*' on its outer face to the center piece 22 of the syphon support 21, which may, in this embodiment, comprise a non-revolving, pivotal ball-bearing part 220. The pivoting movement of the ball-bearing part 220 is represented by arrows $S_1$ in FIG. 3B. The non-revolving, pivotal ball bearing part 220 may be used in conjunction with other embodiments of the arrangement and method in accordance with the invention disclosed herein.

FIG. 3C shows an embodiment of the invention in which the support bearing 20 has been formed so that the axle journal of the support bearing 20 comprises a non-revolving, stationary shaft part 20*b* and a related cylinder part 20*a* which comprises backup grooves of a groove coupling 100 extending in the axial direction along an outer circumferential surface. In the embodiment of FIG. 3C, the central axis of the shaft part 20*b* is denoted by $X_1$ and the central axis of the cylinder part 20*a* as denoted by $X_2$. The shaft part 20*b* is arranged eccentrically in relation to the cylinder part 20*a* (note the space between the axis $X_1$ and the axis $X_2$). Further, the cylinder part 20*a* is arranged inside the extension piece 120 of the condensate pipe 12 and the extension piece 120 comprises an overhang portion constructed to engage with one of the grooves in the cylinder part 20*a*. To lock the groove coupling, the axle journal of the support bearing 20 is shifted in the direction indicated by the arrow $S_2$, whereby one of the grooves receives the overhang portion of the extension piece. During operation, the cylinder part 20*a* is supported in its position by means of the rod 200 (FIG. 3$D_1$). The opposite end of the rod 200 rests against the cover 38.

At the end of the cylinder part 20*a*, there is a threaded hole 26 into which the adjustment tool or rotation roll can be fitted. When the adjustment tool is threaded into the threaded hole 26, the groove coupling between the parts 120 and the axle journal 20*a*,20*b* can be opened by moving the axle journal (20*a*,20*b*) of the support bearing 20 in a direction opposite to the direction of the arrow $S_2$. By rotating the axle journal once a groove is released from engagement with the cooperating overhang (projecting tab), the distance of the syphon pipe from the inner space of the cylinder is adjusted in view of the eccentricity of the cylinder part 20*a* with respect to the shaft part 20*b*.

FIG. $3D_1$ shows the adjustment or rotation tool 200 used for regulation of the syphon and constructed to be positioned in the condensate pipe 12.

FIG. $3D_2$ shows the tool 200 viewed in the direction of the arrow $k_2$ in FIG. $3D_1$. The tool 200 is preferably a plate-like construction although other constructions of rotation tools can be used without deviating from the scope and spirit of the invention.

FIG. 3E shows a water lubrication arrangement for lubricating the glide-bearing means defined between the cylinder part 20*a* and the inner surface of the extension piece 120. In connection with the extension piece 120 connected to the condensate pipe 12 (and preferably out of a direct flow line from the inner surface of the cylinder to the axial portion of the condensate pipe 12), a water guide 31 is arranged and comprises a duct 32 through which condensate water is passed from the condensate pipe 12 to the support bearing, which is thus lubricated with water.

FIG. 3F shows an embodiment in which a water duct 32 has been formed such that it is opened into the condensate pipe 12 towards the flow direction of the condensate (i.e., the opening of the water duct 32 is in the direct flow line from the inner surface of the cylinder to the axial portion of the condensate pipe 12). In this manner, the transfer of condensate water from the condensate pipe 12 to the bearing is facilitated with greater ease. It should be understood that the lubrication of the bearing between the cylinder part 20*a* and the extension piece 120 is only preferably accomplished by the intermediate of the connection between the condensate pipe 12 and/or syphon pipe 12*a* and the condensate being removed from the interior of the cylinder through these pipes and may be any other appropriate lubrication means which apply water or another lubricant to the friction region between these parts experiencing relative movement.

Figure 3G:
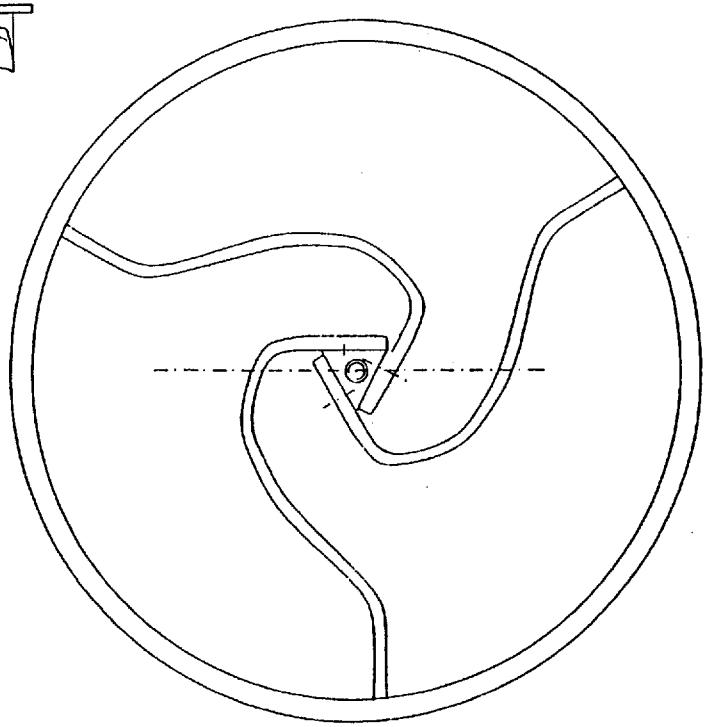
FIG. 3G is a view of the construction of fastening of the static syphon support to the inner face of a cylinder in an arrangement in accordance with the invention.
Figures 3A, 3B, 3C:
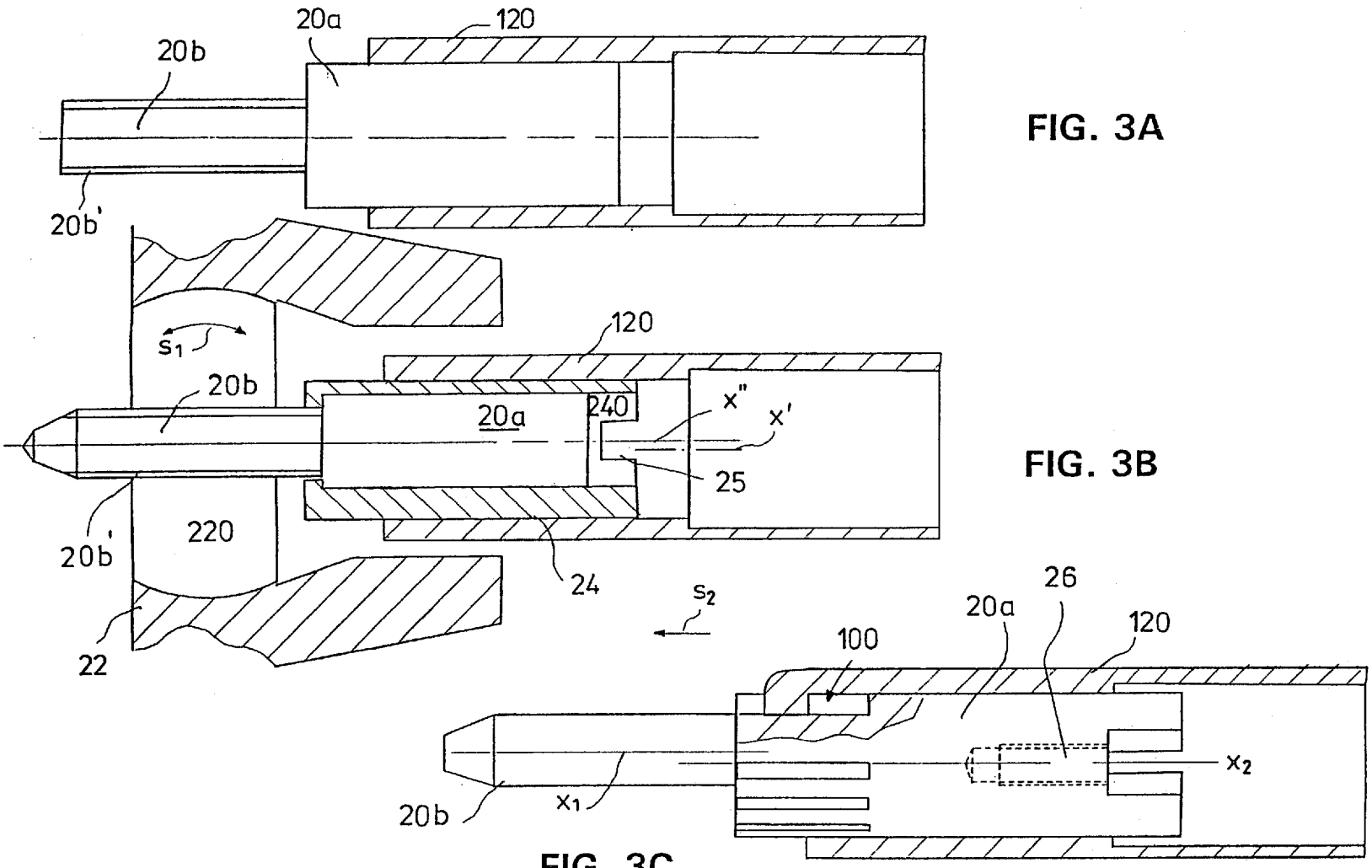
FIG. 3A is a view of a first embodiment of the invention in which the syphon support that revolves along with the cylinder is connected centrally with an axle journal revolving along with the syphon support, which axle journal is provided with an extension part consisting of a cylinder part that operates as a glide bearing.
FIG. 3B is a view of an embodiment of the invention in which the distance of the syphon from the inner face of the drying cylinder is regulated by eccentric bushings.
FIG. 3C is a view of a second embodiment of the eccentric regulation in an arrangement in accordance with the invention.

FIG. 3G shows a preferred embodiment of the syphon support 21, in which the syphon support 21 is attached (detachably or fixedly) to the inner face of the cylinder 10 by means of resilient support arms 21$a_1$,21$a_2$,21$a_3$. The support arms 21$a_1$,21$a_2$,21$a_3$ are further connected to the center piece 22 by means of screws 23 or other comparable fastening means.

Figure 4A:
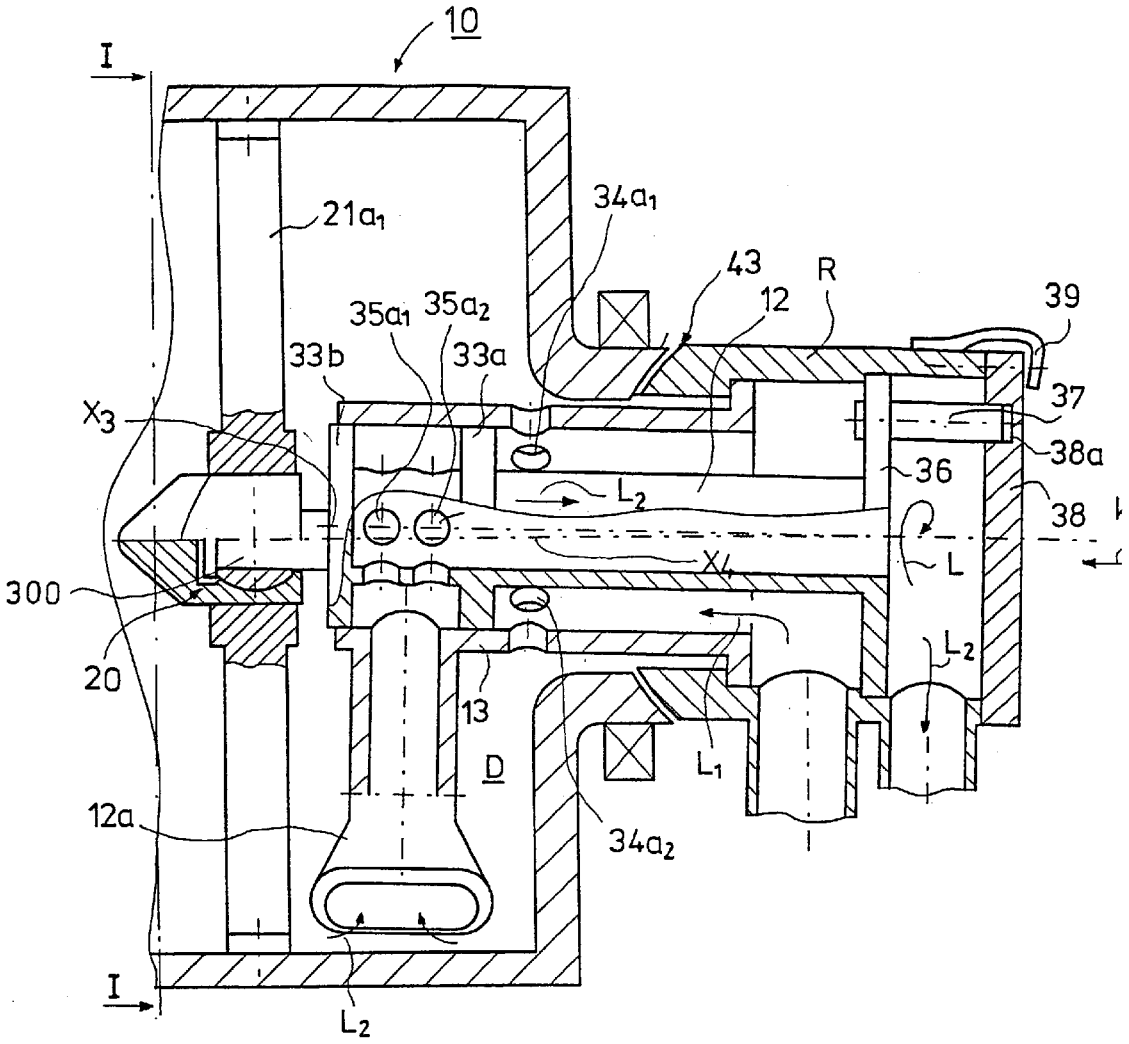
FIG. 4A is a view of an embodiment of the invention in which the bearing arrangement is connected with a rotatable condensate pipe and is a longitudinal sectional view taken from the end of a drying cylinder.

FIG. 4A shows an embodiment of the invention in which the support bearing 20 is connected to the condensate pipe 12 so that the condensate pipe 12 itself is rotatable upon rotation of the cylinder 10 and the central axis $X_3$ of the condensate pipe is positioned eccentrically in relation to the related steam pipe 13 and to the central axis of the steam pipe 13. By rotating the condensate pipe 12, it is possible to regulate the radial position of the steam pipe and thus, the distance of the syphon 12*a* connected with the steam pipe 13 from the inner face of the cylinder 10.

As shown in FIG. 4A, the condensate pipe 12 includes flanges 33*a*,33*b*, between which the syphon 12*a* is in fluid communication with the condensate pipe to pass condensate thereto from the inner face of the cylinder 10. In this embodiment, the syphon 12*a* itself is connected with the steam pipe 13. The steam is passed in the manner indicated by the arrow $L_1$ into the space between the steam pipe 13 and the condensate pipe 12 and further out through holes 34$a_1$, 34$a_2$ . . . in the steam pipe 13, which holes are opened into the interior space D in the cylinder. The openings 34$a_1$,34$a_2$ . . . are placed at a front side of the flange 33*a* on the condensate pipe 12, in which case, the flange 33*a* prevents shifting of the steam further, i.e., into connection with the syphon 12*a* connected to the steam pipe 13 or condensate pipe 12, and guides the steam to be liberated into the space D in the interior of the cylinder. When the condensate pipe 12 is in its position, the flanges 33*a* and 33*b* are placed so that the syphon 12*a*, which is connected with the steam pipe 13, is opened into the space between the flanges 33*a* and 33*b* and the condensate is made to flow into the condensate pipe 12 through the holes 35$a_1$,35$a_2$ provided in the condensate pipe 12 in the area between the flanges 33*a* and 33*b*.

The condensate pipe 12 thus includes flanges 33*b* and 33*a* which are controlled by the inner face of the steam pipe 13 when the condensate pipe 12 is rotated. The pipe portion proper of the condensate pipe 12 and the flanges 33*a*,33*b* on the condensate pipe 12 have the same central axis $X_3$ as that of the steam pipe 13. The flange 33*b* is eccentrically connected with a guide pin 300 which is further connected to the support construction 20,21$a_1$, i.e., the central axis of the guide pin 300 is axially offset from the central axis $X_3$ of the flange 33*b*. The guide pin 300 is arranged to revolve on a bearing. The axis of the guide pin 300 determines the geometric axis of rotation of the condensate pipe 12, i.e., the axis of rotation $X_4$, which differs from the direction of the axis $X_3$. Thus, when the condensate pipe 12 is rotated around the axis $X_4$ on support of the pin 300 (e.g., in the direction of arrow L), the syphon 12*a* connected with the steam pipe 13 is shifted to different distances from the inner face of the cylinder.

A flange 36 is arranged at the end of the condensate pipe 12 and is connected with a pin 37. When the pin 37 is rotated, the condensate pipe 12 is adjustable to the desired position of eccentricity, in which case the portion of the steam pipe 13 placed outside and the connected syphon 12*a* are positioned in the desired position of regulation, and the end of the syphon can be placed at the desired distance from the inner face of the drying cylinder. As shown in FIG. 4A, the flange 36 includes the pin 37 which is placed in a recess 38*a* in the cover 38. The cover 38 is provided with indicator numerals M which can be read from the location of a reading arrow 39, although other indicator means are also within the scope and spirit of the invention. Thus, from a location outside the cylinder 10, it is possible to ascertain the desired position of regulation of the syphon 12*a* and, thus, the desired distance of the syphon pipe from the inner face of the cylinder 10.

Figure 4B:
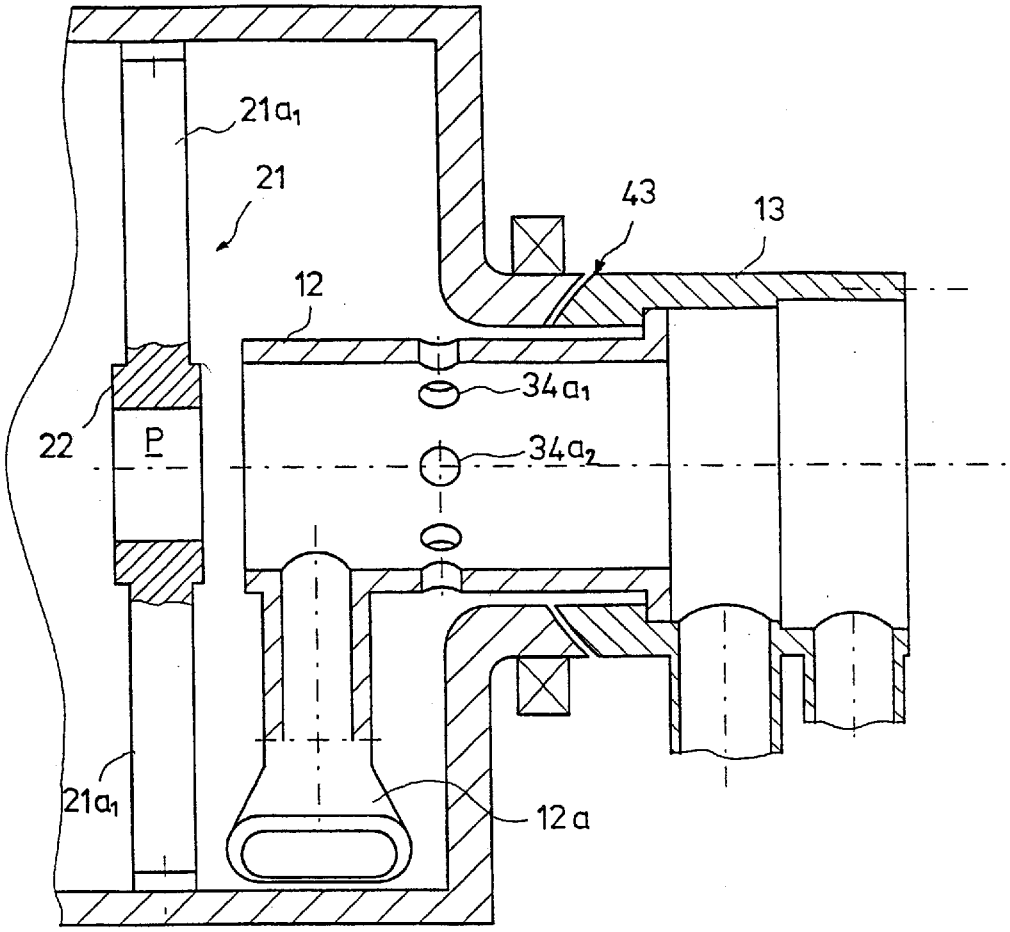
FIG. 4B is a view of the construction of FIG. 4A with the condensate pipe and the related bearing disassembled and separated from one another.
Figure 4B:
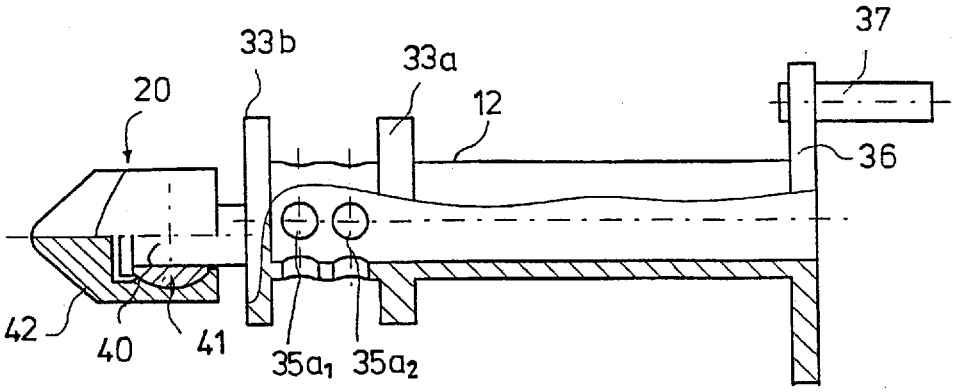
Figure 4C:
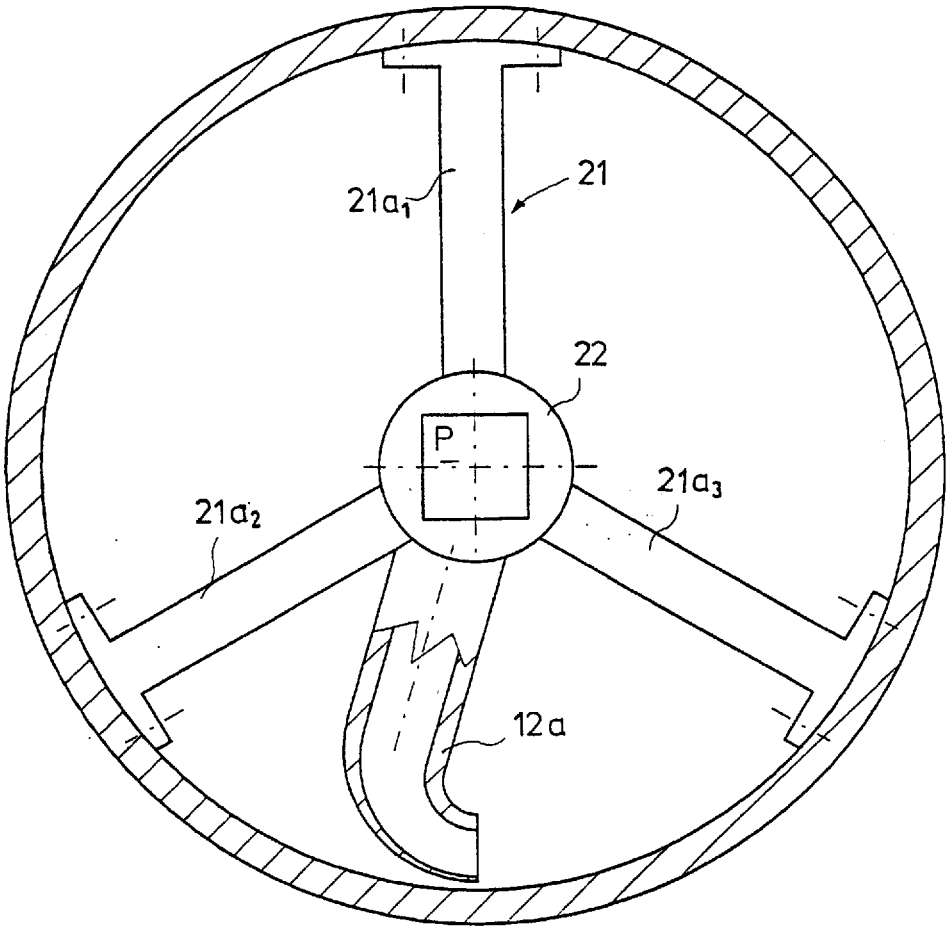
FIG. 4C is a sectional view taken along the line I—I in FIG. 4A.

FIG. 4B shows the construction of FIG. 4A with the condensate pipe and the related bearing disassembled from the rest of the construction. As shown in FIG. 4B, the end of the condensate pipe 12 is connected with a support bearing 20. The support bearing 20 comprises a bearing housing 42, an axle journal 40 situated at least partially within the bearing housing 40 and a ball bearing 41 arranged at an end of the axle journal 40 and pivotable in the bearing housing 42. The bearing housing 42 has an outside shape which corresponds to the shape of a centrally arranged hole P in the center piece 22 of the syphon support 21 (for example, as shown in FIG. 4C, square form). The ball bearing 41 revolves freely and thus permits angular pivoting and movement of rotation of the syphon support. A movement of inclination of the steam pipe is permitted by a bearing 43.

FIG. 4C is a sectional view taken at the line I—I in FIG. 4A and shows the three arms 21$a_1$,21$a_2$ and 21$a_3$, spaced equidistant about the interior of the cylinder 10, although the presence of three arms and equidistant arms is not essential to the operation of the invention. At the end adjacent the inner face of the cylinder 10, the syphon 12*a* has a curved form adapted to have an opening through which condensate on the inner face of the cylinder is drawn into the syphon 12*a*.

Figure 4D:
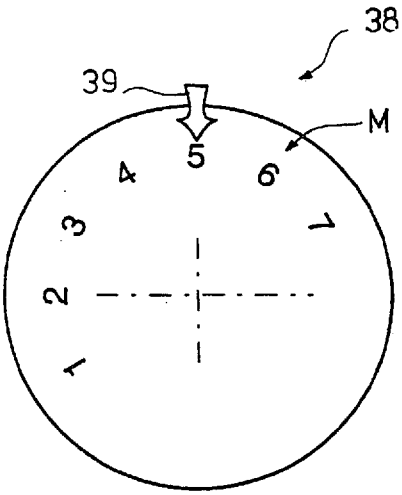
FIG. 4D is a view of a rotatable cover connected with the end of the condensate pipe, viewed in the direction of the arrow $K_1$ in FIG. 4A.

FIG. 4D shows the rotatable cover 38 connected with the end of the condensate pipe 12, which cover 38 includes indicator numerals M for indicating the position of regulation of the syphon from the inner face of the cylinder. From the fixed indicator mark connected with the frame R, such as a reading arrow 39, it is possible to read the position of regulation of the syphon pipe 12*a* at each particular time.

The examples provided above are not meant to be exclusive. Many other variations of the present invention would be obvious to those skilled in the art, and are contemplated to be within the scope of the appended claims. It is noted that the syphon construction in accordance with the invention can be applied at one or both ends of the cylinder.

I claim:

1. In an arrangement for removing condensate from an interior of a drying cylinder having a revolving axle journal and a steam pipe through which steam is passed into the interior of the drying cylinder, the arrangement including a condensate pipe arranged at least partially within the axle journal for passing condensate out of the interior of the drying cylinder and a syphon pipe fluidly communicating with the condensate pipe and arranged in the interior of the drying cylinder such that condensate is drawn from the interior of the drying cylinder through said syphon pipe and passed to the condensate pipe to be removed from the interior of the drying cylinder, the improvement comprising:

syphon support means arranged in the interior of the drying cylinder for supporting said syphon pipe, said syphon support means being coupled to the drying cylinder such that said syphon support means rotate with the drying cylinder, and bearing means for rotatably coupling said syphon support means to the condensate pipe to enable rotation of said syphon support means relative to the condensate pipe, said bearing means comprising a support bearing coupled to the condensate pipe and defining a rotation axis offset in relation to a central axis of said syphon support means such that said syphon pipe is movable to different positions relative to the drying cylinder to thereby enable a distance between an end of said syphon pipe proximate an inner face of the drying cylinder and the inner face of the drying cylinder to be varied.

2. The arrangement of claim 1, wherein said support bearing comprises a shaft part having a central axis coincident with the central axis of said syphon support means such that said syphon support means rotate with the drying cylinder about said shaft part.

3. The arrangement of claim 1, wherein said support bearing engages with said syphon support means and is directly coupled to the condensate pipe.

4. The arrangement of claim 1, wherein the condensate pipe comprises an end piece arranged to receive at least a portion of said support bearing.

5. The arrangement of claim 4, wherein said end piece comprises a hollow, bushing part including a connection to a flow passage of condensate through the condensate pipe.

6. The arrangement of claim 4, further comprising lubrication means for lubricating a bearing region situated between said end piece and said support bearing, said lubrication means comprising a water guide arranged in said end piece to direct condensate passing through the condensate pipe to said bearing region.

7. The arrangement of claim 1, wherein said support bearing comprises an axle journal including a cylinder part arranged at least partially within the condensate pipe and a shaft part connected to said cylinder part and rotatably coupled to said syphon support means, said syphon support means comprising a center piece housing said shaft part, the condensate pipe comprising an end piece arranged to receive at least a portion of said cylinder part in an interior thereof such that a glide bearing is formed between an outer face of said cylinder part and inner face of said end piece.

8. The arrangement of claim 7, further comprising coupling means for coupling said shaft part to said center piece of said syphon support means, said coupling means comprising cooperating threads arranged on said shaft part and said centerpiece of said syphon support means.

9. The arrangement of claim 1, wherein the condensate pipe comprises an elongate end piece, said support bearing comprising an axle journal including a cylinder part and a shaft part connected to said cylinder part and rotatably coupled to said syphon support means, and a substantially cylindrical bushing arranged at an end of said end piece, said bushing having a substantially cylindrical cavity having a central axis offset in relation to a central axis of said bushing, said central axis of said bushing being the rotation axis of said support bearing, said central axis of said cavity being coincident with the central axis of said syphon support means, said cylinder part of said axle journal of said bearing means being arranged in said central cavity of said bushing.

10. The arrangement of claim 9, further comprising indicator means arranged on an outside of the drying cylinder for indicating a position of said bushing and thus a distance of said syphon pipe from the inner face of the drying cylinder.

11. The arrangement of claim 1, wherein the condensate pipe comprises an end piece, said support bearing comprising an axle journal including a cylinder part arranged at least partially in connection with said end piece and a shaft part connected to said cylinder part and rotatably coupled to said syphon support means, said cylinder part having an outer circumferential surface having a plurality of grooves and said end piece having a projection engageable with one of said grooves such that a groove coupling is formed between said projection of said end piece and one of said grooves and rotation of said axle journal of said bearing means is prevented.

12. The arrangement of claim 1, wherein the condensate pipe comprises an end piece, said support bearing comprising an axle journal including an elongate cylinder part arranged at least partially in connection with said end piece and a shaft part connected to said cylinder part and rotatably coupled to said syphon support means, said shaft part having a central axis offset from a central axis of said cylinder part, the central axis of said shaft part being coincident with the central axis of said syphon support means, the central axis of said cylinder part being the rotation axis of said support bearing.

13. The arrangement of claim 12, wherein said cylinder part includes a threaded hole in one end, further comprising a rotation tool cooperating with said threaded hole in said cylinder part for removing said bearing means without disassembly of the axle journal of the drying cylinder and for adjusting a distance between an end of said syphon pipe proximate the inner face of the drying cylinder and the inner face of the drying cylinder.

14. The arrangement of claim 1, wherein said syphon support means comprises a centerpiece arranged in a central region of the interior of the drying cylinder, at least one arm extending from said centerpiece to the inner face of the drying cylinder and connected to the inner face of the drying cylinder, and pivot means for enabling pivotal movement of said centerpiece and said at least one arm relative to said bearing means.

15. In an arrangement for removing condensate from an interior of a drying cylinder having a revolving axle journal and a steam pipe through which steam is passed into the interior of the drying cylinder, the arrangement including a condensate pipe arranged at least partially within the axle journal for passing condensate out of the interior of the drying cylinder and a syphon pipe fluidly communicating with the condensate pipe and arranged in the interior of the drying cylinder such that condensate is drawn from the interior of the drying cylinder through said syphon pipe and passed to the condensate pipe to be removed from the interior of the drying cylinder, the improvement comprising:

syphon support means arranged in the interior of the drying cylinder for supporting said syphon pipe, said syphon support means being coupled to the drying cylinder such that said syphon support means rotate with the drying cylinder, bearing means for rotatably coupling said syphon support means to the condensate pipe to enable rotation of said syphon support means relative to the condensate pipe, said bearing means comprising a support bearing arranged in connection with said syphon support means, the condensate pipe being rotatably coupled to said support bearing such that the condensate pipe is rotatable with said syphon support means, said syphon pipe being connected to a steam pipe through which steam is passed into the interior of the cylinder and the condensate pipe being arranged within the steam pipe, and first and second flanges connected to the condensate pipe, said flanges extending outward from the condensate pipe to engage an inner face of the steam pipe, the condensate pipe having apertures between said first and second flanges and the steam pipe having an aperture situated between said first and second flanges leading to said syphon pipe to enable fluid communication between the condensate pipe and said syphon pipe.

16. The arrangement of claim 15, wherein the axle journal of the drying cylinder has an inlet connection for steam leading to the steam pipe and an outlet connection for condensate leading from the condensate pipe, further comprising a third flange connected to the condensate pipe for separating the inlet connection from the outlet connection, and rotation means for rotating the condensate pipe, said rotation means comprising an elongate pin connected at a first end to said third flange, and a cover connected to a second end of said pin, said cover including visible indicator marks for showing a rotation position of the condensate pipe.

17. The arrangement of claim 15, wherein the condensate pipe has an axis of rotation arranged eccentric in relation to a central axis of the steam pipe such that by rotating the condensate pipe, the steam pipe and said syphon pipe are movable to different distances from the inner face of the drying cylinder in view of the engagement of said first and second flanges with the steam pipe.

18. In a method for regulating the removal of condensate from an interior of a drying cylinder into which steam is passed through a steam pipe and condensate is removed from the interior of the drying cylinder through a syphon pipe arranged in the interior of the drying cylinder and a condensate pipe fluidly communicating therewith, the improvement comprising the steps:

supporting the syphon pipe in the interior of the drying cylinder by means of a syphon support attached to an inner face of the drying cylinder such that said syphon support revolves along with the cylinder, connecting the syphon pipe to the condensate pipe, arranging a support bearing between the syphon support and the condensate pipe such that the syphon support is rotatable relative to the condensate pipe, and regulating the temperature of an outer surface of the drying cylinder by adjusting a distance between a condensate inlet opening of the syphon pipe and the inner face of the cylinder, said step of regulating the temperature of the outer surface of the drying cylinder comprising the step of providing the support bearing with an eccentric bushing such that the condensate pipe is rotatable relative to the syphon support in an eccentric manner.

19. The method of claim 18, further comprising the step of rotating the eccentric bushing to thereby cause rotation of the condensate pipe relative to the syphon support in an eccentric manner and movement of the condensate pipe and syphon pipe to a certain distance from the inner face of the drying cylinder so as to regulate the removal of condensate from the inner face of the drying cylinder and adjust the temperature of the outer surface of the cylinder.

20. In an arrangement for removing condensate from an interior of a drying cylinder having a revolving axle journal and a steam pipe through which steam is passed into the interior of the drying cylinder, the arrangement including a condensate pipe arranged at least partially within the axle journal for passing condensate out of the interior of the drying cylinder and a syphon pipe fluidly communicating with the condensate pipe and arranged in the interior of the drying cylinder such that condensate is drawn from the interior of the drying cylinder through said syphon pipe and passed to the condensate pipe to be removed from the interior of the drying cylinder, the improvement comprising:

a syphon support arranged in the interior of the drying cylinder for supporting said syphon pipe, said syphon support being coupled to the drying cylinder such that said syphon support rotates with the drying cylinder, and a support bearing for rotatably coupling said syphon support to the condensate pipe to enable rotation of said syphon support relative to the condensate pipe, said support bearing being coupled to the condensate pipe and defining a rotation axis offset in relation to a central axis of said syphon support such that said syphon pipe is movable to different positions relative to the drying cylinder to thereby vary a distance between an end of said syphon pipe proximate an inner face of the drying cylinder and the inner face of the drying cylinder.

21. In an arrangement for removing condensate from an interior of a drying cylinder having a revolving axle journal and a steam pipe through which steam is passed into the interior of the drying cylinder, the arrangement including a condensate pipe arranged at least partially within the axle journal for passing condensate out of the interior of the drying cylinder and a syphon pipe fluidly communicating with the condensate pipe and arranged in the interior of the drying cylinder such that condensate is drawn from the interior of the drying cylinder through said syphon pipe and passed to the condensate pipe to be removed from the interior of the drying cylinder, the improvement comprising:

syphon support means arranged in the interior of the drying cylinder for supporting said syphon pipe, said syphon support means being coupled to the drying cylinder such that said syphon support means rotate with the drying cylinder, bearing means for rotatably coupling said syphon support means to the condensate pipe to enable rotation of said syphon support means relative to the condensate pipe, said bearing means comprising a support bearing arranged at least partially in the condensate pipe and engaging with said syphon support means, and lubrication means for lubricating a bearing region situated between the condensate pipe and said support bearing, said lubrication means comprising a water guide arranged in the condensate pipe to direct condensate passing through the condensate pipe to said bearing region.

22. In an arrangement for removing condensate from an interior of a drying cylinder having a revolving axle journal and a steam pipe through which steam is passed into the interior of the drying cylinder, the arrangement including a condensate pipe arranged at least partially within the axle journal for passing condensate out of the interior of the drying cylinder and a syphon pipe fluidly communicating with the condensate pipe and arranged in the interior of the drying cylinder such that condensate is drawn from the interior of the drying cylinder through said syphon pipe and passed to the condensate pipe to be removed from the interior of the drying cylinder, the improvement comprising:

syphon support means arranged in the interior of the drying cylinder for supporting said syphon pipe, said syphon support means being coupled to the drying cylinder such that said syphon support means rotate with the drying cylinder, bearing means for rotatably coupling said syphon support means to the condensate pipe to enable rotation of said syphon support means relative to the condensate pipe, said bearing means comprising an axle journal including a cylinder part arranged at least partially within the condensate pipe and a shaft part connected to said cylinder part and rotatably coupled to said syphon support means, said syphon support means comprising a center piece housing said shaft part, the condensate pipe comprising an end piece arranged to receive at least a portion of said cylinder part in an interior thereof such that a glide bearing is formed between an outer face of said cylinder part and inner face of said end piece, and coupling means for coupling said shaft part to said center piece of said syphon support means, said coupling means comprising cooperating threads arranged on said shaft part and said center piece of said syphon support means.

23. In an arrangement for removing condensate from an interior of a drying cylinder having a revolving axle journal and a steam pipe through which steam is passed into the interior of the drying cylinder, the arrangement including a condensate pipe arranged at least partially within the axle journal for passing condensate out of the interior of the drying cylinder and a syphon pipe fluidly communicating with the condensate pipe and arranged in the interior of the drying cylinder such that condensate is drawn from the interior of the drying cylinder through said syphon pipe and passed to the condensate pipe to be removed from the interior of the drying cylinder, the improvement comprising:

syphon support means arranged in the interior of the drying cylinder for supporting said syphon pipe, said syphon support means being coupled to the drying cylinder such that said syphon support means rotate with the drying cylinder, and bearing means for rotatably coupling said syphon support means to the condensate pipe to enable rotation of said syphon support means relative to the condensate pipe, the condensate pipe comprising an end piece, said bearing means comprising an axle journal including a cylinder part arranged at least partially in connection with said end piece and a shaft part connected to said cylinder part and rotatably coupled to said syphon support means, said cylinder part having an outer circumferential surface having a plurality of grooves and said end piece having a projection engageable with one of said grooves such that a groove coupling is formed between said projection of said end piece and one of said grooves and rotation of said axle journal of said bearing means is prevented.

* * * * *